US005746180A

United States Patent [19]

Jefferson et al.

[11] Patent Number: 5,746,180

[45] Date of Patent: May 5, 1998

[54] FUEL SUPPLY APPARATUS

[75] Inventors: John Roderick Jefferson, Rainham; Peter Alban George Collingborn; Michael Peter Cooke, both of Gillingham; Paul Buckley, Rainham, all of United Kingdom

[73] Assignee: Lucas Industries Public Limited Company, Solihull, England

[21] Appl. No.: 303,695

[22] Filed: Sep. 9, 1994

[30] Foreign Application Priority Data

Sep. 14, 1993 [GB] United Kingdom ..... 9318963
Sep. 14, 1993 [GB] United Kingdom ..... 9318969

[51] Int. Cl.[6] ..... F02M 7/00

[52] U.S. Cl. ..... 123/447; 123/450

[58] Field of Search ..... 123/447, 450, 123/458, 506; 417/462

[56] References Cited

U.S. PATENT DOCUMENTS

| | | | |
|---|---|---|---|
| 4,601,274 | 7/1986 | Seilly | 123/447 |
| 4,757,795 | 7/1988 | Kelly | 123/458 |
| 4,767,288 | 8/1988 | Straubel | 123/458 |
| 5,005,548 | 4/1991 | Rembold | 123/447 |
| 5,078,113 | 1/1992 | Haag et al. | 123/447 |
| 5,215,060 | 6/1993 | Klopfer | 123/450 |
| 5,327,869 | 7/1994 | Rembold | 123/450 |

FOREIGN PATENT DOCUMENTS

| | | |
|---|---|---|
| 2079366 | 6/1981 | United Kingdom . |
| 93/22554 | 11/1993 | WIPO . |

*Primary Examiner*—Carl S. Miller
*Attorney, Agent, or Firm*—Jacobson, Price, Holman & Stern, PLLC

[57] ABSTRACT

A fuel supply apparatus for supplying fuel to a compression ignition engine comprising a rotary distributor member having a delivery passage which can register in turn with outlet ports connected to the injection nozzles of the engine. Fuel is supplied to the delivery passage from an accumulator under the control of a valve. The accumulator is charged with fuel by means of a high pressure pump which is a cam actuated pump and fuel is supplied to the high pressure pump by a low pressure pump. A valve is provided to control the output pressure of the low pressure pump so that the amount of fuel supplied to the high pressure pump can be varied for the purpose of controlling the fuel pressure within the accumulator. This pressure is sensed by a transducer which supplies a signal to a control system which controls the flow of electric current in the valve.

11 Claims, 6 Drawing Sheets

FUEL SUPPLY APPARATUS

BACKGROUND OF THE INVENTION

This invention relates to a fuel supply system for supplying fuel to the injection nozzles of a multi-cylinder compression ignition engine, the system comprising a cam actuated high pressure pump, an accumulator space which is charged with fuel by the high pressure pump, a rotary distributor member including a delivery passage which is arranged to register in turn with a plurality of outlet ports, the outlet ports being formed in a housing which supports the distributor member and being connected in use to the injection nozzles respectively, valve means operable to connect said delivery passage to the accumulator space to supply fuel to the engine and to connect said delivery passage to a drain, and passage means through which fuel can flow to the high pressure pump.

U.S. Pat. No. 5,078,113 shows one example of such a fuel supply system in which the accumulator comprises a spring biased piston which is housed within a cylinder and the high pressure pump comprises a pumping plunger which is spring biased into engagement with an engine driven cam. The high pressure pump is able to draw fuel from a supply tank and an adjustable throttle is provided to control the amount of fuel which is supplied to the high pressure pump, the throttle being coupled to the accumulator piston so as to be movable thereby.

PCT/DE93/00330 which has a priority date before that of the present application but which was published after the priority date of the present application shows another example of the supply system and which is intended to supply fuel at a much higher pressure than the system disclosed in U.S. Pat. No. 5,078,113. The accumulator comprises a simple chamber which is depicted as being formed in the housing of the apparatus. The fuel pressure in the accumulator space can be controlled by a simple spring loaded relief valve or by an electromagnetic valve which is controlled by a control system which receives a pressure signal from a sensor responsive to the pressure in the accumulator space.

SUMMARY OF THE INVENTION

The object of the present invention is to provide a fuel system of the kind specified in an improved form.

According to one aspect of the invention a fuel system of the kind specified comprises a low pressure fuel supply pump which supplies fuel to the high pressure pump through said passage means, a pressure sensor for providing a signal representative of the pressure in the accumulator space, an electrically controlled pressure control valve operable to control the output pressure of the low pressure pump and an electronic control system responsive to the signal provided by said sensor for controlling the operation of said control valve whereby the output pressure of the low pressure pump can be varied to control the amount of fuel delivered by the high pressure pump to the accumulator space.

According to a further aspect of the invention a fuel system of the kind specified comprises a low pressure fuel supply pump which supplies fuel to the high pressure pump through said passage means, an electrically controlled throttle valve in said passage means, a pressure sensor for providing a signal representative of the fuel pressure in said accumulator space and an electronic control system responsive to the signal provided by said pressure sensor for controlling the operation of said throttle thereby to control the amount of fuel delivered by the high pressure pump to the accumulator space.

According to a still further aspect of the invention said accumulator space is formed in an accumulator block which is secured to a housing which houses the high pressure pump.

According to another aspect of the invention a fuel system of the kind specified includes means for modifying the initial rate of fuel flow to the engine.

BRIEF DESCRIPTION OF THE DRAWINGS

An example of a fuel system in accordance with the invention will now be described with reference to the accompanying drawings, in which.

DESCRIPTION OF THE PREFERRED EMBODIMENTS

Figure 1:
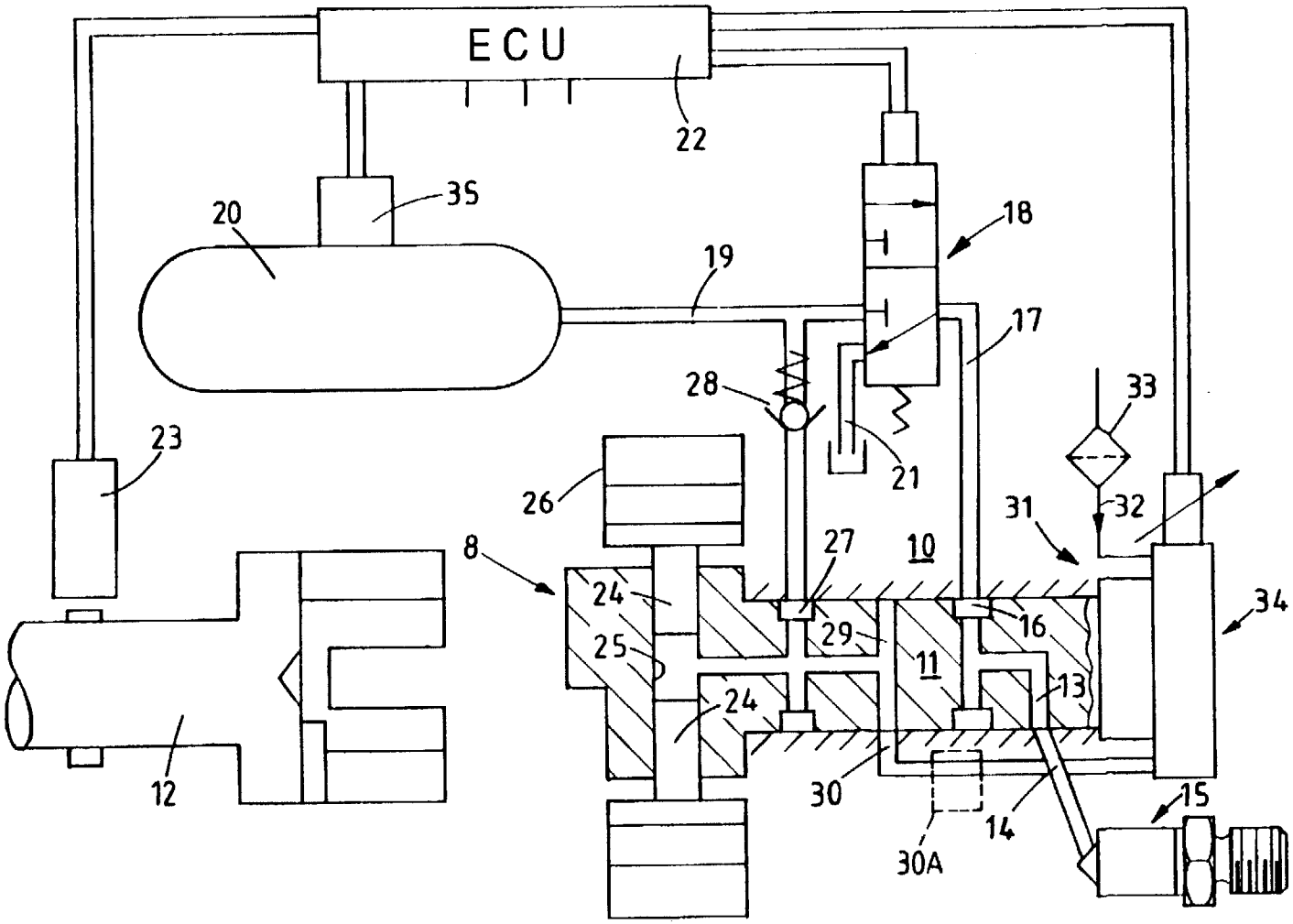
FIG. 1 is a diagrammatic representation of one example of the system.

Referring to FIG. 1 of the drawings the fuel system comprises a housing 10 in which is mounted a rotary cylindrical distributor member 11. The distributor member is arranged to be rotated in timed relationship with the associated engine by means of a drive shaft 12 which is shown to be separated from the distributor member but which in practice is coupled thereto. The distributor member includes a delivery channel which is in the form of an outwardly extending delivery passage 13 formed in the distributor member and which is positioned to register in turn with a plurality of outlet ports 14 only one of which is shown. The outlet ports are connected to outlets 15 formed in the housing and there are as many outlet ports and outlets as there are engine cylinders. The outlets in use are connected to the injection nozzles of the associated engine and the usual delivery valves may be located in the outlets respectively.

The delivery passage 13 communicates with a circumferential groove 16 formed on the periphery of the distributor member and this is in constant communication with a passage 17 formed at least in part in the housing. The passage 17 can communicate by way of an electromagnetically operable valve 18 with either a further passage 19 which is connected to an accumulator chamber 20 or with a drain passage 21.

The valve 18 is a two position valve and in one position as shown in the drawing, the passage 17 is connected to the drain 21. In the other position the connection to the drain is blocked off and the passage 17 communicates with the passage 19. The valve is controlled by an electromagnetic actuator which is supplied with current by an electronic control system 22. The control system acts to control the speed of the engine in accordance with various engine operating parameters and also in accordance with a demand signal which is provided by a transducer responsive to the position of the operator controlled throttle pedal of the vehicle associated with the engine. The control system may also receive signals indicative of the engine temperature and air temperature etc. In addition, it receives a signal or signals from a transducer system 23 which is responsive to the passage past the sensor of teeth formed on the drive shaft 12.

From this signal a signal can be derived indicative of the engine speed and also the engine position.

Assuming for the moment that the accumulator is charged with fuel at high pressure, when the delivery passage 13 is in register with an outlet port 14, the valve 18 can be operated to permit flow of fuel from the accumulator 20 to the outlet port and the fuel injection nozzle in communication therewith, so that fuel is supplied to the associated engine. The amount of fuel and the timing of delivery are controlled by varying the length of time the valve member of the valve 18 is in the alternative position to that shown and the instant at which the valve operates. When the valve member assumes the position shown the pressure in the passage 17 and the groove and delivery passage within the distributor member is reduced to drain pressure which may be the pressure within the pump housing.

In the example the accumulator is charged with fuel by means of a cam actuated high pressure fuel pump 8 which conveniently is in the form of a pair of reciprocable pumping plungers 24 located within a diametrically disposed bore 25 formed in a part of the distributor member which extends from the housing. At their outer ends the plungers are engaged by shoes respectively each of which carries a roller which can engage with the internal peripheral surface of an annular cam ring 26. The bore 25 is in constant communication with a circumferential groove 27 formed on the periphery of the distributor member and this communicates with the passage 19 and therefore the accumulator chamber 20 by means of a non-return valve 28 which may be constituted by one or more valves. The bore 25 is also in communication with a diametrically disposed inlet passage 29 formed in the distributor member and which when the plungers are allowed to move outwardly, communicates with a filling port or ports 30 formed in the housing 10.

The filling ports 30 communicate with the outlet of a low pressure vane type pump 31 the rotary part of which conveniently is secured to the rotary distributor member 11. The pump 31 has a fuel inlet 32 which by way of the usual filter 33, is connected to a source of supply. Associated with the pump 31 is a pressure control valve 34 which affords variable communication between the outlet and the inlet of the pump in order to control the fuel delivery pressure of the low pressure pump. Conveniently the valve 34 is electrically controlled with the control being effected by the control system 22. The control system 22 also receives a signal from a sensor 35 which is responsive to the pressure of fuel within the accumulator.

The cam ring 26 is provided with a plurality of pairs of cam lobes the leading flanks of which considered in terms of the direction of rotation of the distributor member, impart inward movement to the plungers. During such movement the inlet passage 29 is out of register with the filling ports 30 so that the fuel displaced by the plungers is supplied to the accumulator by way of the valve 28. As the rollers ride over the crests of the cam lobes, the plungers can move outwardly and it is whilst the plungers are under the control of the trailing flanks of the cam lobes that the passage 29 is in communication with a filling port 30. When such communication is established fuel can flow to the bore 25 from the low pressure pump and the amount of fuel which flows can be varied by adjusting the outlet pressure of the low pressure pump using the control valve 34. Adjusting the outlet pressure of the low pressure pump 31 does vary the quantity of fuel which flows into the bore 25 due to the restrictive nature of the passages which connect the outlet of the low pressure pump with the bore 25. The control system controls the setting of the valve 34 in response to the signal provided by the pressure transducer 35. It is therefore possible to regulate the pressure in the accumulator using the valve 34 and the control valve 34 only has to deal with and be designed for use with fuel at a low pressure.

The ability to regulate the pressure within the accumulator is an important advantage of the present system over the usual cam actuated pump systems such as the normal distributor type pump in which the plungers form the high pressure pump, and the unit/injector type of pump. With these pumps ensuring that fuel is delivered at a sufficiently high pressure through the injection nozzle at low engine speeds means that at high engine speeds the pressure may be higher than is required. With the system as described the pressure in the accumulator can be controlled so that the injection pressure is suitable for all engine operating speeds and loads. Furthermore, the construction of the pump embodies well known and well tried technology.

The valve 18 is shown as a two position spool valve with a single valve member. It can be replaced by two valves which are actuated separately with one valve acting when open to connect the accumulator to the passage 17 and the other acting when open to connect the passage 17 to the drain. In this way one valve can be used to start delivery of fuel and the other to terminate delivery of fuel. Other forms of valve can be used and in addition, instead of direct actuation by the actuator the valves may be actuated using a hydraulic or pneumatic arrangement.

Moreover, the valve or valves may be operated by using a piezo-electric crystal stack or stacks.

The low pressure pump 31 is shown as having its rotary part mounted on the end of the distributor member remote from the drive shaft and is a vane type pump. The pump may however be driven directly by the drive shaft and be mounted in the portion of the housing which supports the drive shaft.

The low pressure pump may be in the form of a single or an additional pair or more of plungers mounted in the distributor member. The additional plungers must operate in antiphase to the plungers 24 and either have to be appropriately positioned relative to the plungers 24 or have to be actuated by cam lobes on a separate cam ring. Moreover, the additional plungers must be spring biased outwardly to provide the required pumping action, or otherwise positively primed for example by supplying the fuel at low pressure from an external pump.

As described the fuel is supplied to the bore 25 by way of the inlet port or ports 30 and the passage 19, from the low pressure pump. Instead of the ports and passage which form a valve to prevent fuel displaced by the plungers being returned to the low pressure pump, a simple non-return valve may be provided.

If the amount of fuel which is required to pressurise the accumulator is greater than can be supplied by the two plungers 24, a further pair of plungers may be provided. These may be located in a further bore which is disposed in the same plane as the bore 25 or they may be located in a bore which is disposed in another plane. In the former case the further plungers would have further cam followers at their outer ends and be actuated by the same cam ring 26. Alternatively or in addition, the further bore can be located in spaced side-by-side relationship with the two bores being radially aligned and with adjacent pairs of plungers sharing a cam follower. Separate cam followers may be provided for the sets of plungers with separate cam rings.

In the conventional distributor type pump the shapes of at least the leading flanks of the cam lobes are similar and are dictated by the required fuel injection characteristic and the crests of the cam lobes are shaped to provide as rapid a termination of fuel delivery as possible. Moreover, the number of cam lobes is dictated by the number of engine cylinders. In the present system the number of constraints on the cam lobe profile is reduced and the cam lobes can be shaped to reduce the driving torque fluctuation and to reduce the stresses in the material forming the crests of the cam lobes and the rollers. In addition, the number of pumping strokes of the plungers per revolution of the drive shaft can be greater or less than the number of engine cylinders.

Figure 2:
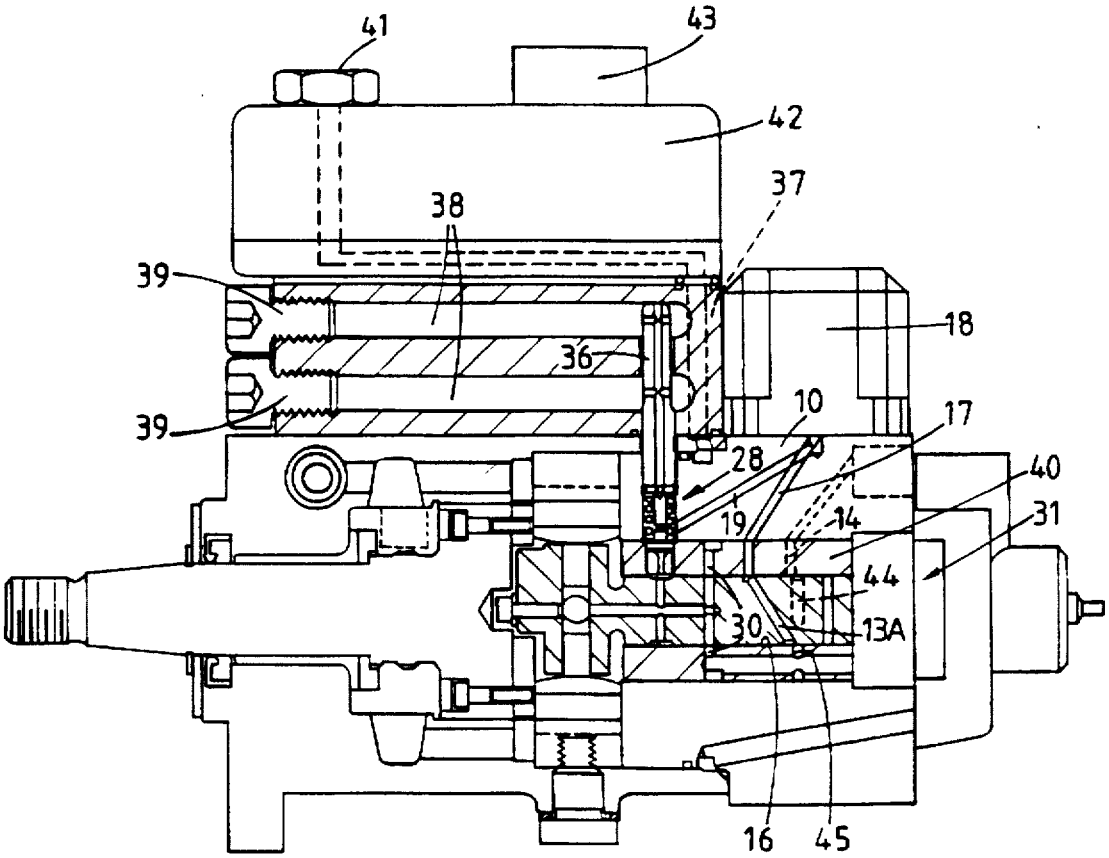
FIG. 2 shows one practical version of the system seen in FIG. 1.

FIG. 2 shows a practical realization of the apparatus shown in FIG. 1. The valve 28 is shown as being similar to a conventional non-return delivery valve such as may be incorporated in the outlets 15, and includes a valve member having a fluted guide portion which is located in a drilling formed in a part of the housing. The valve member is provided with a valve head which is urged into engagement with a seating defined at the outer end of the drilling. The extent of movement of the valve member against the action of the spring is limited by a stop which is formed by the reduced end of a spigot member 36 which extends from the housing 10. Alternative forms of valve can be used such as a ball valve as shown in FIG. 1 or valve with a tubular guide portion.

The spigot 36 extends into an accumulator block 37 which is secured to the housing 10. In the block is formed a pair of blind drillings 38 which have their open ends closed by plugs 39. Adjacent their closed ends the drillings are interconnected by a cross bore and in the wall of the block and extending into one of the drillings is a further bore. When the block is secured in position the spigot 36 extends through the bores and forms a fuel tight seal with the further bore. The spigot is provided with an axial passage which through cross passages interconnects the drillings 38 with the spring chamber of the valve 28. The drillings 38 form an accumulator volume and during rotation of the distributor member the fuel in the drillings is pressurised to the desired pressure by the high pressure pump. Although two drillings 38 are provided these may be replaced by a single drilling of larger diameter or by three or more drillings. As an alternative to the accumulator volume being formed by drillings in the separate accumulator block 37, the accumulator volume may be formed in the portion of the housing which houses the distributor member. As an example the accumulator volume may be defined as an annular groove between the sleeve 40 which surrounds the distributor member and the housing part 10 in which the sleeve 40 is mounted. It is also possible to locate the accumulator away from the housing and to connect it to the spring chamber of the valve 28 by a suitable conduit.

In the arrangement shown in FIG. 2 the control system 22 is located in an enclosure 42 which is secured on the accumulator block 37. The fuel inlet 41 to the low pressure pump 31 conveniently passes through a wall of the enclosure to provide for cooling of the components of the control system. Moreover, in order to minimise heat transfer from the accumulator block 37 to the enclosure 42 a heat insulating barrier layer may be interposed therebetween. An electrical socket 43 is provided on the enclosure to enable connections to external sensors and a power supply to be effected. As with the accumulator the control system may be positioned remote from the housing.

Where the low pressure pump 31 has its inlet connected to a source of fuel external of the housing 10 a vent must be provided on the housing to allow any fuel which leaks into the housing to escape. Such leakage can occur from the working clearance between the distributor member and the sleeve 40 and from the working clearances between the plungers and the bore or bores in which they are located. The inlet of the low pressure pump 31 may be connected to the space within the housing in which case the source of fuel is connected to the interior of the housing.

In the arrangement shown in FIG. 1 the delivery passage 13 is shown connected to the groove 16 by means of a short axial passage. The construction of the axial passage would in practice require an axial drilling to be formed in the distributor member and closed by a plug. FIG. 2 shows that the delivery passage 13A may be drilled obliquely from the groove 16. Furthermore, there is shown in FIG. 2 a part circumferential groove 44 which is permanently connected to the outlet of the low pressure pump by way of a port 45 or by way of a further port (not shown) which is positioned diametrically opposite the port 45 and which is connected to the outlet of the low pressure pump. The outlet end of the delivery passage 13A is located between the ends of the groove 44 and the arrangement is such that once an outlet port 14 has received fuel from the delivery passage 13A it is wiped by the groove 44 before it next receives fuel. In this way the outlet ports 14 after receiving fuel are brought to a common pressure before the next delivery of fuel. This action acts to ensure that any cavities in the fuel columns intermediate the outlet ports 14 and the delivery valves in the outlets 15 are dissipated. A side thrust will be imposed on the distributor member by the fuel pressure in the delivery passage 13A and this can be partly compensated for by providing a short groove extending from the groove 16 at a position diametrically opposite the outlet end of the delivery passage 13A. In addition it is possible to provide a further passage which extends obliquely from the outlet end of the passage 13A to the periphery of the distributor member in a manner complementary to the passage 13A.

As an alternative to the groove 44, a wiping port may be formed in the distributor member in the same plane as the outlet end of the delivery passage 13A. The wiping port is connected by obliquely drilled passages in the distributor member to a circumferential groove on the distributor member which is in communication with the outlet of the low pressure pump.

In the arrangements so far described the extent of outward movement of the plungers 24 and hence the amount of fuel supplied to the accumulator has been determined by altering the output pressure of the low pressure pump 31 using the valve 34 associated with the low pressure pump 31. Other methods can be used to control the outward movement of the plungers. For example, the output pressure of the low pressure pump could be controlled by a simple relief valve and the flow of fuel to the bore 25 could be controlled by an axially or angularly adjustable throttle valve 30A the position of which may be controlled by an electrical actuator. The throttle valve 30A may be located as shown in FIG. 1, in the passage which connects the outlet of the low pressure pump 34 with the transfer port 30 and would be controlled by the control system 22 in response to the signals provided by the sensor. Alternatively a metering shuttle may be utilised having an electrically controlled stroke control mechanism, or as a further alternative, the allowed stroke of the pumping plungers 24 can be varied using adjustable mechanical stops. Instead of controlling the pressure in the accumulator by adjusting the quantity of fuel delivered by the pumping plungers, a controllable relief valve may be provided on the accumulator.

Figure 3:
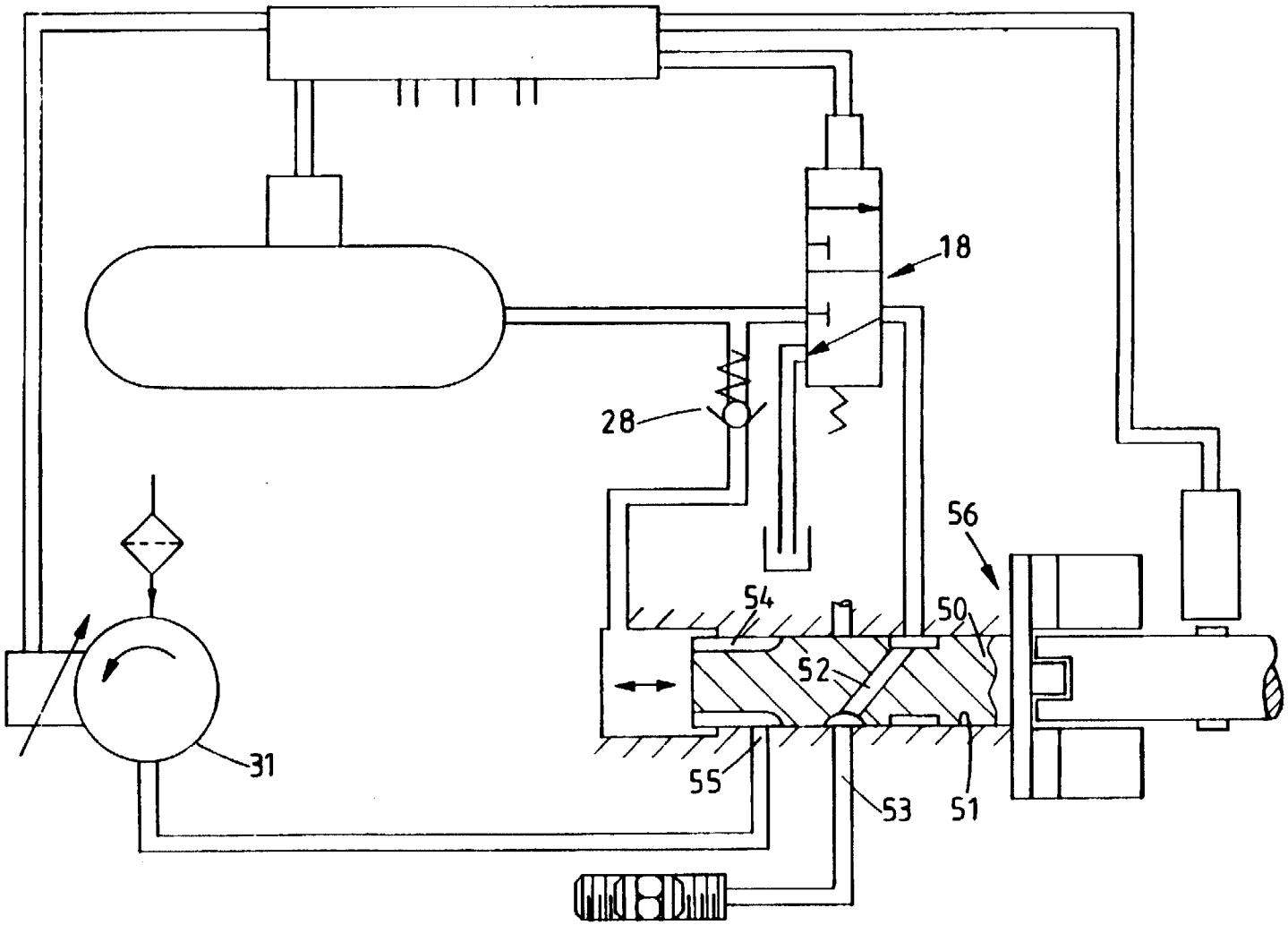
FIG. 3 is a view similar to FIG. 1 showing another example of the system.

FIG. 3 shows how the concept of the present invention can be applied to a distributor pump of the kind in which the distributor member 50 besides rotating to perform the distributing function also is axially movable in a bore 51 to perform the pumping function. The delivery passage is shown at 52 and delivers fuel from the valve 18 to outlet ports 53 in turn. The low pressure pump 31 delivers fuel to the closed end of the bore 51 through grooves 54 formed in the distributor member and which register in turn with an inlet port 55. The distributor member is actuated by a face cam and roller mechanism 56 which is well known in the art and a return spring (not shown) is provided to move the distributor member out of the bore following its inward movement by the cam and roller mechanism. The quantity of fuel delivered to the accumulator may be determined by controlling the output pressure of the low pressure pump 31 or it could be controlled by spilling surplus fuel.

Figure 4:
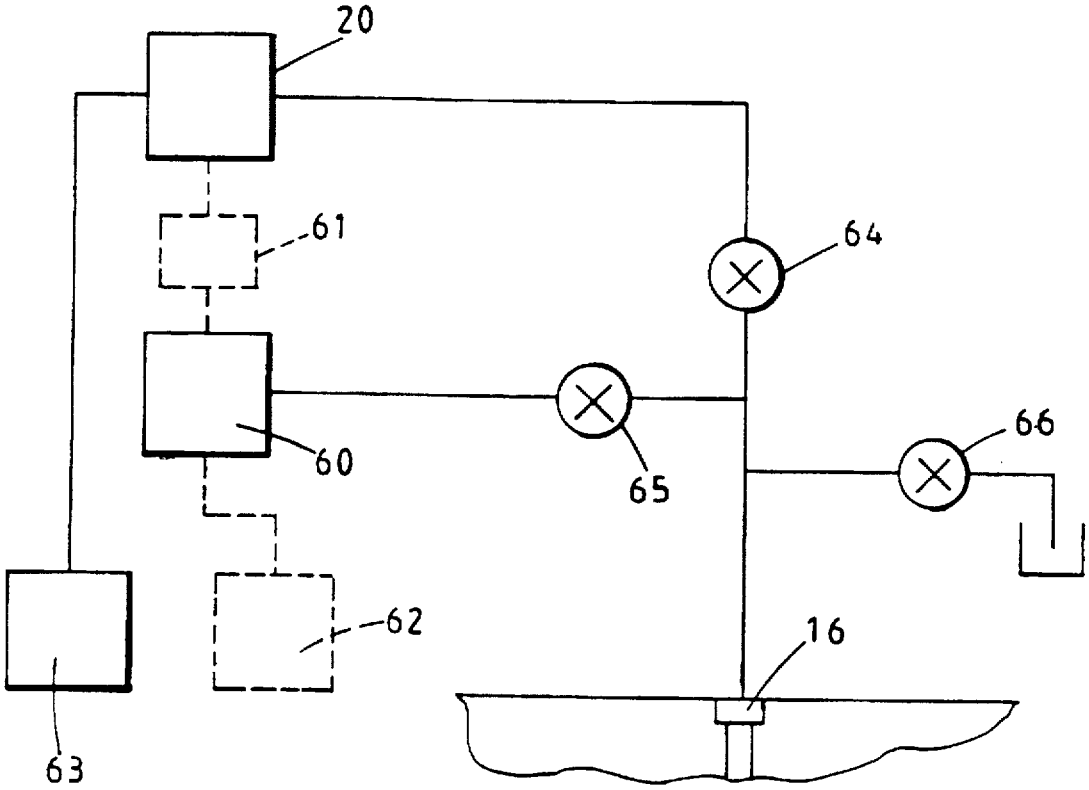
FIG. 4 shows in diagrammatic form a modification to the system shown in FIG. 1, and FIGS. 5 and 6 show further examples of the fuel system.

One of the advantages of the systems as described is the fact that the accumulator pressure can be chosen so that the pressure is adequate at high engine speeds without being excessive at idle speed. A disadvantage which applies to all systems where an electromagnetic valve is used to control fuel quantity, is the operating time of the valve. At low engine loads and high engine speeds, the minimum operating time of the valve 18 may be such that the incorrect fuel quantity is delivered to the engine. The amount of fuel supplied during the minimum operating time of the valve can be reduced by reducing the fuel pressure in the accumulator. Clearly the pressure must always be sufficient to ensure atomization of the fuel. However reducing the pressure means that the effective fuel capacity of the accumulator is reduced so that if for example the operator of the engine makes a sudden demand for increased engine power there will be insufficient fuel available in the accumulator to meet the demand. The response of the engine will therefore be impaired. This difficulty may be overcome by providing as shown in FIG. 4, a further accumulator 60 which contains fuel at a lower pressure. The further accumulator 60 may be charged with fuel through a pressure reducing valve 61 from the main accumulator 20 or by a separate high pressure pump 62 formed by a separate set of pumping plungers carried by the distributor member, the existing high pressure pump being shown at 63. Each of the pumps would require a non-return valve as illustrated at 28 in FIG. 1 to prevent the return flow of fuel from the accumulators. The selection of which accumulator to take fuel from can be effected by providing a pair of valves 64, 65 associated with the accumulators 20, 60 respectively. The valves in this case are simple ON/OFF valves in order to prevent loss of fuel to drain and a further ON/OFF valve 66 is provided to provide for termination of delivery of fuel to the engine. This arrangement can also be used to provide control of the initial rate of fuel delivery through the outlets 15 by operating the valves 65, 64 in turn when it is required to deliver fuel to the engine. In this case a non-return valve in series with the valve 65 associated with the further accumulator 60 would be required to prevent flow of fuel between the two accumulators.

It has already been stated that the cam lobes can be designed to reduce driving torque fluctuation. This is achieved by making the leading flanks of the cam lobes which impart inward movement to the plungers 24 less steep than in a conventional distributor type fuel pump. It is proposed to supply fuel displaced by the plungers to the delivery passage in order to provide an initial flow of fuel at a reduced rate to the engine. The plungers may also be utilized to supply all the fuel for engine idling or other low rate requirements. In this event the number of pumping strokes of the plungers per revolution of the distributor member must be the same as the number of engine cylinders.

Figure 5:
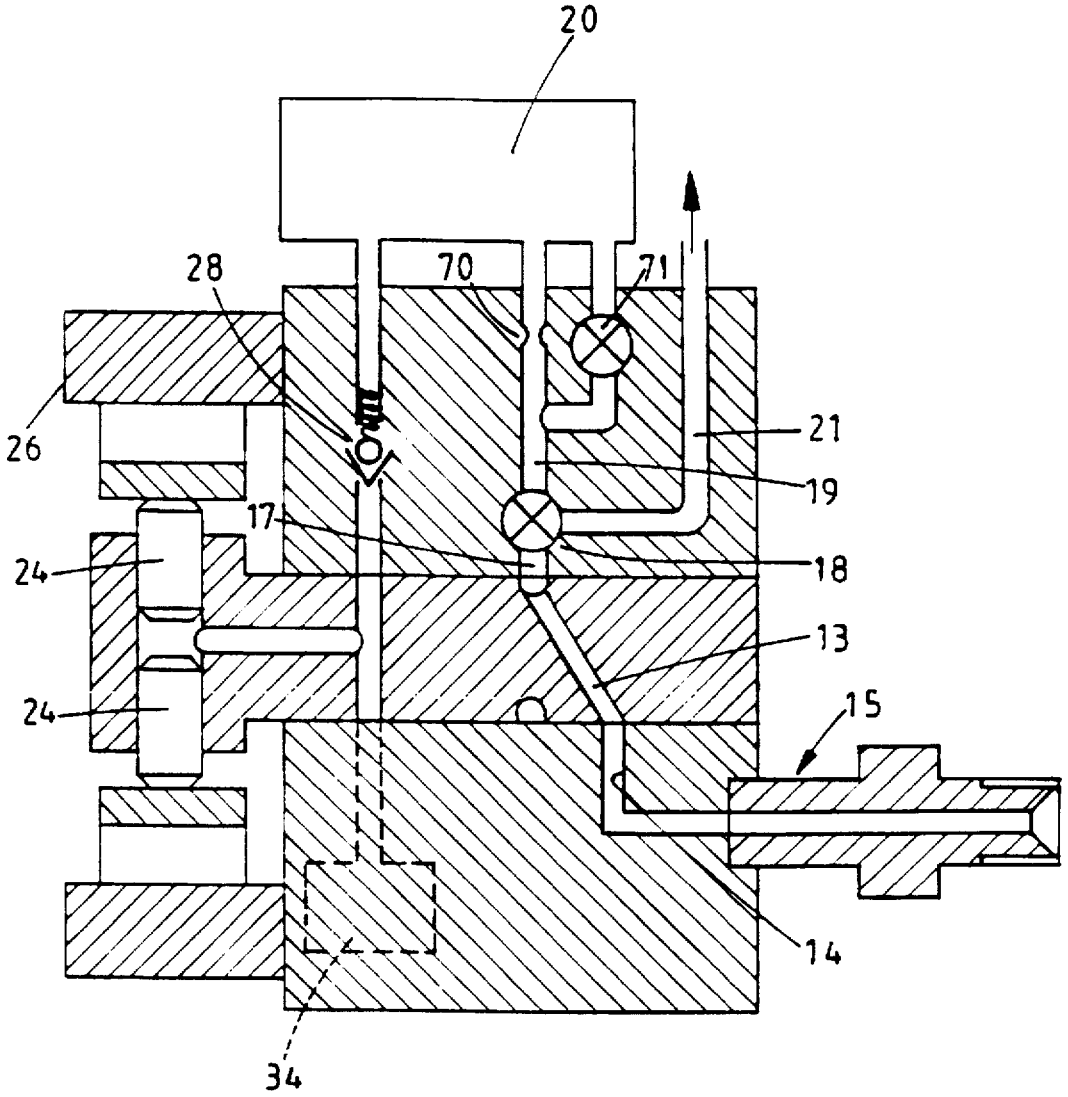

In the arrangement shown in FIG. 5 like reference numerals to those used in FIG. 1 are utilised for corresponding parts and in this arrangement the accumulator 20 is connected by way of a restrictor 70 to the valve 18 and in parallel with the restrictor is an ON/OFF valve 71.

The high pressure pump constituted by the plungers 24, is utilised only to charge the accumulator 20 and for this purpose is connected to the accumulator by way of the non-return valve 28. The pressure within the accumulator may be controlled using a relief valve or alternatively an arrangement may be provided to control the volume of fuel delivered by the high pressure pump. One way of reducing the fuel flow from the high pressure pump is to use a throttle to restrict the rate at which fuel flows into the pump. As an alternative some form of plunger stroke control may be provided.

In operation, prior to the start of fuel delivery the valve 71 is closed and the valve 18 is in the second position in which the passages 17 and 21 are in communication with each other. When the delivery passage 13 has moved into register with an outlet port 14 the valve 18 is moved to its first position in which the passages 17 and 19 are connected together so that fuel can flow from the accumulator 20 to the delivery passage 13. The rate of flow of fuel is controlled by the size of the restrictor 70. When it is deemed that sufficient fuel has been supplied at the restricted rate, the valve 71 is opened to allow fuel flow at a substantially unrestricted rate and when sufficient fuel has been supplied to the engine the valve 18 is moved to its second position so that the flow of fuel from the accumulator is halted and the delivery passage 13 is vented to the drain. Before the next delivery of fuel takes place the valve 71 is closed and the process is repeated with fuel being supplied to the outlets 14 in turn. The high pressure pump is conveniently arranged to charge the accumulator with fuel each time delivery of fuel takes place to the associated engine and the delivery of fuel by the high pressure pump to the accumulator may commence whilst fuel is being supplied to the engine.

As an alternative to the restrictor 70 and the ON/OFF valve 71, a variable lift valve may be provided in the passage 19. In this case the variable lift valve may be utilised to initiate delivery of fuel whilst the valve 19 is in its first position, with the valve 19 being used to terminate delivery of fuel by moving it to its second position.

Figure 6:
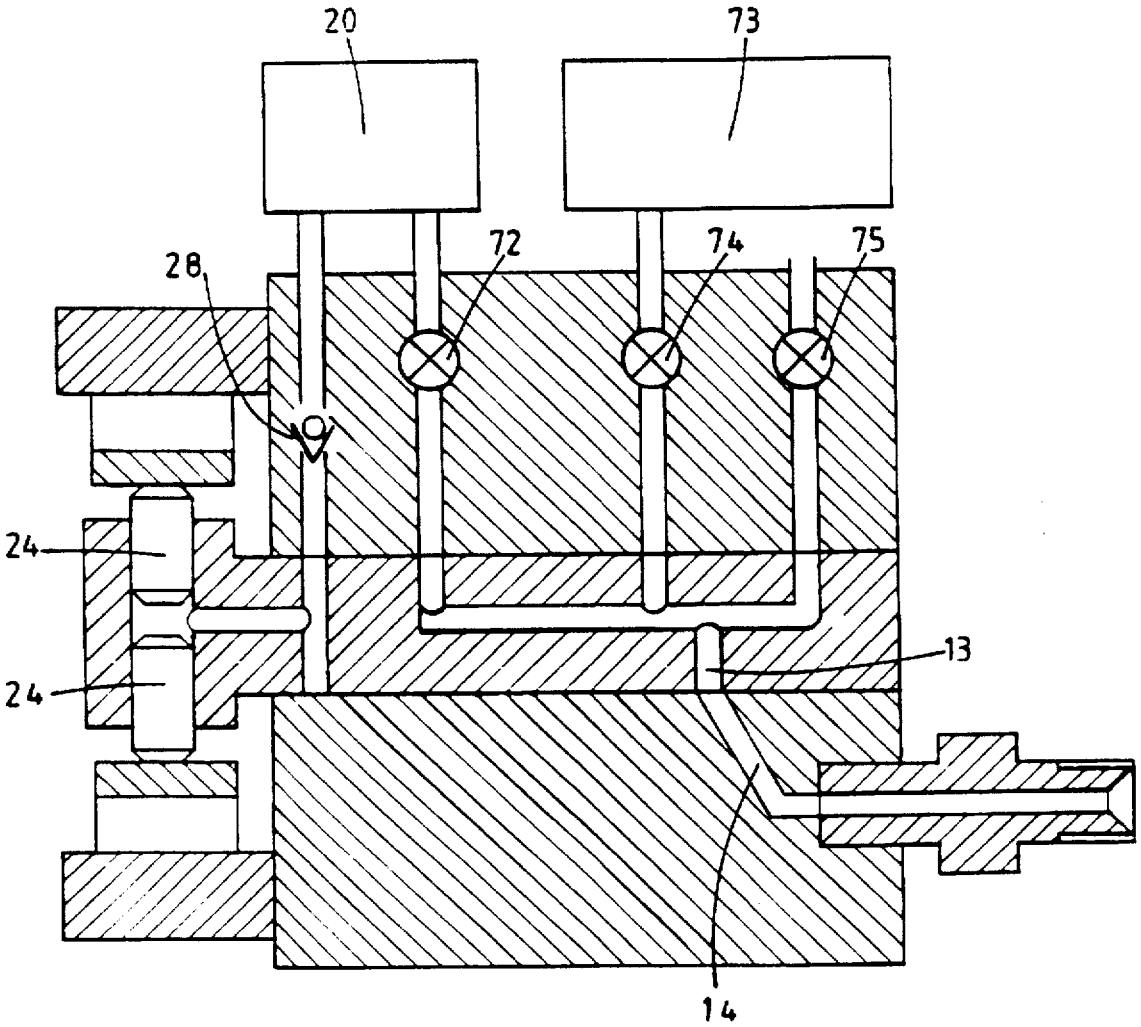

In the arrangement which is shown in FIG. 6, the high pressure pump is utilised to charge the accumulator 20 by way of a non-return valve 28. A first ON/OFF valve 72 is provided to connect the accumulator 20 to the delivery passage 13 and when this valve is opened fuel flows to the engine at the maximum rate. In order to provide a reduced rate of flow of fuel to the engine a second accumulator 73 is provided in which fuel is stored at a lower pressure and this accumulator can be connected to the delivery passage 13 by way of a second ON/OFF valve 74. A third ON/OFF valve 75 is provided to connect the delivery passage 13 to a drain. In operation, when the delivery passage 13 registers with an outlet port 14, the valve 75 is closed and the valve 74 opened to allow fuel to flow at a reduced rate to the associated engine because of the lower pressure in the accumulator 73. When sufficient fuel has been supplied at the reduced rate the valve 72 is opened and the valve 74 closed so that the rate of flow of fuel to the engine increases due to the higher pressure in the accumulator 20. Termination of delivery of fuel to the engine is achieved by closing the valve 72 and opening the valve 75.

In some instances all the fuel which is supplied to the engine is derived from the accumulator 73 whereas in other instances at the instant of closure of the valve 74 the valve 75 is opened to terminate delivery of fuel to provide so called pilot injection of fuel and at the appropriate time the valve 75 is closed and the valve 72 opened to provide the main delivery of fuel.

In order to pressurise the accumulator 73 a separate high pressure pump may be provided. As an alternative the accumulator 73 may be charged from the accumulator 20 by appropriate operation of the valves 72 and 74 preferably during the time when the delivery passage 13 is out of register with an outlet port 14. Individual relief valves may be utilised to control the pressures in the accumulators 20 and 73 or the pressures particularly in the accumulator 20, may be controlled by appropriate operation of the valves 72 and 75.

We claim:

1. A fuel supply system for supplying fuel to the injection nozzles of a multi-cylinder internal combustion engine comprising a cam actuated high pressure pump, an accumulator space which is charged with fuel by the high pressure pump, a rotary distributor member including a delivery passage which is arranged to register in turn with a plurality of outlet ports, the outlet ports being formed in a housing which supports the distributor member and being connected in use, to the injection nozzles respectively, valve means operable to connect said delivery passage to the accumulator space to supply fuel to the engine and to connect said delivery passage to a drain, passage means through which fuel can flow to the high pressure pump, a low pressure fuel supply pump which supplies fuel to the high pressure pump through said passage means, a pressure sensor for providing a signal representative of the pressure in the accumulator space, an electrically controlled pressure control valve operable to control the output pressure of the low pressure pump and an electronic control system responsive to the signal provided by said sensor for controlling the operation of said control valve whereby the output pressure of the low pressure pump can be varied to control the amount of fuel delivered by the high pressure pump to the accumulator space.

2. A fuel supply system according to claim 1, in which said low pressure pump is a vane type pump.

3. A fuel supply system for supplying fuel to the injection nozzles of a multi-cylinder internal combustion engine comprising a cam actuated high pressure pump, an accumulator space which is charged with fuel by the high pressure pump, a rotary distributor member including a delivery passage which is arranged to register in turn with a plurality of outlet ports, the outlet ports being formed in a housing which supports the distributor member and being connected in use, to the injection nozzles respectively, valve means operable to connect said delivery passage to the accumulator space to supply fuel to the engine and to connect said delivery passage to a drain, passage means through which fuel can flow to the high pressure pump, a low pressure fuel supply pump which supplies fuel to the high pressure pump through said passage means, an electrically controlled throttle valve in said passage means, a pressure sensor for providing a signal representative of the fuel pressure in the accumulator space and an electronic control system responsive to the signal provided by said pressure sensor for controlling the operation of said throttle valve thereby to control the amount of fuel delivered by the high pressure pump to the accumulator space.

4. A fuel supply system for supplying fuel to the injection nozzles of a multi-cylinder internal combustion engine comprising a cam actuated high pressure pump, an accumulator space which is charged with fuel by the high pressure pump, a rotary distributor member including a delivery passage which is arranged to register in turn with a plurality of outlet ports, the outlet ports being formed in a housing which supports the distributor member and being connected in use, to the injection nozzles respectively, valve means operable to connect said delivery passage to the accumulator space to supply fuel to the engine and to connect said delivery passage to a drain, and passage means through which fuel can flow to the high pressure pump, said accumulator space being formed in an accumulator block adapted to be secured to a housing which houses the high pressure pump, and further including a spigot mounted on the housing, said spigot having an internal drilling which communicates with said high pressure pump, said accumulator block having an opening to receive said spigot and the drilling within the spigot communicating with the accumulator space.

5. A fuel supply system according to claim 4, in which said accumulator space is defined by drillings formed in the accumulator block, said drillings being blind and extending inwardly from one face of the accumulator block, the open ends of the drillings being closed by plugs.

6. A fuel supply system according to claim 5, including an electronic control system for controlling the operating of said valve means, an enclosure for said control system, said enclosure being mounted on the accumulator block and having in a wall thereof a fuel inlet leading to the low pressure pump.

7. A fuel supply system for supplying fuel to the injection nozzles of a multi-cylinder internal combustion engine comprising a cam actuated high pressure pump, an accumulator space which is charged with fuel by the high pressure pump, a rotary distributor member including a delivery passage which is arranged to register in turn with a plurality of outlet ports, the outlet ports being formed in a housing which supports the distributor member and being connected in use, to the injection nozzles respectively, valve means operable to connect said delivery passage to the accumulator space to supply fuel to the engine and to connect said delivery passage to a drain, and passage means through which fuel can flow to the high pressure pump, and means operable to limit at least the initial rate of flow of fuel from the accumulator space to the associated engine.

8. A fuel system according to claim 7, including by a restrictor in series between the accumulator space and said valve means and an ON/OFF valve connected in parallel with said restrictor, said ON/OFF valve being opened when a substantially unrestricted flow of fuel is required.

9. A fuel supply system for supplying fuel to the injection nozzles of a multi-cylinder internal combustion engine comprising a cam actuated high pressure pump, an accumulator space which is charged with fuel by the high pressure pump, a rotary distributor member including a delivery passage which is arranged to register in turn with a plurality of outlet ports, the outlet ports being formed in a housing which supports the distributor member and being connected in use, to the injection nozzles respectively, valve means operable to connect said delivery passage to the accumulator space to supply fuel to the engine and to connect said delivery passage to a drain, passage means through which fuel can flow to the high pressure pump, a further accumulator space in which fuel is stored at a lower pressure, said valve means comprising a first valve operable to connect said first mentioned accumulator space to said delivery passage when a substantially unrestricted fuel delivery to the engine is required, a second valve operable to connect the further accumulator space to the delivery passage when a restricted fuel delivery to the engine is required and a third valve operable to connect said delivery passage to a drain to terminate delivery of fuel to the engine.

10. A fuel system according to claim 9, including a further pump for charging the further accumulator space.

11. A fuel system according to claim 9, in which said further accumulator space is charged with fuel under pressure from the first mentioned accumulator space by operation of the first and second valves.

* * * * *